US008729378B2

(12) United States Patent
Ryan et al.

(10) Patent No.: US 8,729,378 B2
(45) Date of Patent: May 20, 2014

(54) NON-CONTACT CYMBAL PICKUP USING MULTIPLE MICROPHONES

(75) Inventors: Christopher Ryan, Northampton, MA (US); Julia D. Truchsess, Sandy Hook, CT (US); David A. McDonald, Merrimack, NH (US)

(73) Assignee: Avedis Zildjian Co., Norwell, MA (US)

( * ) Notice: Subject to any disclaimer, the term of this patent is extended or adjusted under 35 U.S.C. 154(b) by 232 days.

(21) Appl. No.: 13/232,821

(22) Filed: Sep. 14, 2011

(65) Prior Publication Data

US 2012/0060669 A1 Mar. 15, 2012

Related U.S. Application Data

(60) Provisional application No. 61/383,304, filed on Sep. 15, 2010.

(51) Int. Cl.
*G10H 1/00* (2006.01)

(52) U.S. Cl.
USPC ..... 84/723; 84/737; 84/742; 84/743; 381/87; 381/97; 381/118; 381/355; 381/361

(58) Field of Classification Search
USPC ..... 381/87, 97, 111, 118, 119, 355, 162, 381/361; 84/723, 737, 742, 743
See application file for complete search history.

(56) References Cited

U.S. PATENT DOCUMENTS

| | | | | |
|---|---|---|---|---|
| 2,845,491 | A * | 7/1958 | Bertram | 381/26 |
| 3,509,264 | A | 4/1970 | Green | |
| 3,553,339 | A | 1/1971 | Dominguez et al. | |
| 4,248,129 | A | 2/1981 | Zildjian | |
| 4,353,008 | A | 10/1982 | Dorfman | |
| 4,466,596 | A * | 8/1984 | Cohen | 248/635 |
| 4,579,229 | A | 4/1986 | Porcaro et al. | |
| 5,056,399 | A | 10/1991 | Hornstein | |

(Continued)

FOREIGN PATENT DOCUMENTS

| | | |
|---|---|---|
| FR | 2 592 979 | 7/1987 |
| GB | 2 173 031 | 10/1986 |
| JP | H11-184459 A | 7/1999 |
| JP | 2009-251477 A | 10/2009 |

OTHER PUBLICATIONS

International Search Report and Written Opinion in PCT Application No. PCT/US11/62959, mailed Apr. 4, 2012.

(Continued)

*Primary Examiner* — David S. Warren
(74) *Attorney, Agent, or Firm* — Wolf, Greenfield & Sacks, P.C.

(57) ABSTRACT

As described herein, a sound pickup for musical cymbals includes an integrated assembly attachable to a cymbal stand. The integrated assembly includes a plurality of microphones arranged and electrically connected such that the resulting amplified sound is of optimal quality and of relatively constant loudness regardless of cymbal tilt. In one embodiment, two microphones are used, with the signal phase from one microphone being inverted prior to combination with the signal from the other microphone. The inversion is implemented using an inverter and serves to cancel signals that are in phase with one another and augment signals that are out of phase with one another. This, along with suitable placement of the pickup, exploits the fact that the more desirable components of the cymbal's vibration at the inflection point of the cymbal are out of phase with each other, whereas the less-desirable components are in phase with each other.

13 Claims, 9 Drawing Sheets

(56) References Cited

U.S. PATENT DOCUMENTS

| | | | | |
|---|---|---|---|---|
| 5,125,134 | A | 6/1992 | Morita | |
| 5,459,283 | A | 10/1995 | Birdwell, Jr. | |
| 5,520,292 | A | 5/1996 | Lombardi | |
| 5,526,430 | A * | 6/1996 | Ono et al. | 381/26 |
| 5,703,306 | A * | 12/1997 | Liao | 84/421 |
| 6,093,878 | A | 7/2000 | Hoshino | |
| 6,252,967 | B1 | 6/2001 | Moore et al. | |
| 6,610,916 | B1 * | 8/2003 | Torrez | 84/421 |
| 6,815,598 | B1 * | 11/2004 | Liao | 84/327 |
| 6,835,887 | B2 | 12/2004 | Devecka | |
| 6,881,885 | B2 * | 4/2005 | Yoshino et al. | 84/402 |
| 7,015,391 | B2 * | 3/2006 | Tomoda | 84/726 |
| 7,024,006 | B1 * | 4/2006 | Schwartz et al. | 381/98 |
| 7,323,632 | B2 | 1/2008 | Wachter | |
| 7,488,887 | B2 | 2/2009 | Mori | |
| 7,507,902 | B2 | 3/2009 | Ludwig | |
| 7,589,275 | B2 | 9/2009 | Arimoto | |
| 7,608,771 | B2 | 10/2009 | Fournier et al. | |
| 7,667,130 | B2 | 2/2010 | Mishima | |
| 7,838,753 | B2 | 11/2010 | Steele | |
| 7,851,687 | B2 | 12/2010 | Chang et al. | |
| 8,023,665 | B2 * | 9/2011 | Schwartz | 381/98 |
| 8,063,296 | B2 | 11/2011 | Copeland et al. | |
| 8,315,418 | B2 * | 11/2012 | Watanabe | 381/358 |
| 8,497,418 | B2 * | 7/2013 | Roderick et al. | 84/737 |
| 2001/0043704 | A1 * | 11/2001 | Schwartz | 381/98 |
| 2002/0018573 | A1 | 2/2002 | Schwartz | |
| 2002/0186998 | A1 * | 12/2002 | Chen et al. | 403/97 |
| 2003/0221545 | A1 * | 12/2003 | Tomoda | 84/723 |
| 2005/0039593 | A1 | 2/2005 | Wachter | |
| 2005/0126373 | A1 | 6/2005 | Ludwig | |
| 2005/0145101 | A1 | 7/2005 | Yoshino | |
| 2006/0021495 | A1 * | 2/2006 | Freitas | 84/723 |
| 2006/0081116 | A1 * | 4/2006 | Copeland et al. | 84/421 |
| 2007/0137460 | A1 | 6/2007 | Mori | |
| 2007/0154037 | A1 * | 7/2007 | Schwartz | 381/118 |
| 2008/0163739 | A1 | 7/2008 | Mori | |
| 2008/0205669 | A1 | 8/2008 | Michelet | |
| 2009/0007754 | A1 | 1/2009 | May | |
| 2009/0020659 | A1 * | 1/2009 | Crous | 248/125.8 |
| 2009/0179522 | A1 | 7/2009 | Cappello et al. | |
| 2009/0225021 | A1 | 9/2009 | Ye et al. | |
| 2010/0005954 | A1 | 1/2010 | Higashidate et al. | |
| 2010/0177516 | A1 | 7/2010 | Chang et al. | |
| 2010/0180750 | A1 | 7/2010 | Steele | |
| 2011/0064230 | A1 * | 3/2011 | Goldfarb | 381/26 |
| 2011/0194703 | A1 * | 8/2011 | Akino et al. | 381/26 |
| 2011/0311064 | A1 * | 12/2011 | Teutsch | 381/26 |
| 2011/0312318 | A1 * | 12/2011 | Konchitsky | 455/422.1 |
| 2012/0055318 | A1 | 3/2012 | Miniaev | |
| 2012/0060669 | A1 * | 3/2012 | Ryan et al. | 84/723 |
| 2012/0060670 | A1 * | 3/2012 | Truchsess | 84/724 |
| 2012/0118130 | A1 | 5/2012 | Field | |
| 2012/0144980 | A1 * | 6/2012 | Roderick et al. | 84/723 |
| 2012/0186419 | A1 * | 7/2012 | Roderick et al. | 84/723 |
| 2013/0047826 | A1 * | 2/2013 | Wissmuller | 84/723 |
| 2013/0125735 | A1 * | 5/2013 | Mori | 84/723 |
| 2013/0312590 | A1 | 11/2013 | Truchsess | |

OTHER PUBLICATIONS

Office Action in U.S. Appl. No. 12/966,965, mailed Jun. 22, 2012.
Office Action in U.S. Appl. No. 13/436,683, mailed May 29, 2012.
U.S Nottice of Allowance in U.S. Appl. No. 12/966,965, mailed on Apr. 3, 2013.
Supplemental Notice of Allowance in U.S. Appl. No. 12/966,965, mailed on May 13, 2013.
O'Reilly et al., "Sonic Nirvana: Using MEMS Accelerometers as Acoustic Pickups in Musical Instruments," Analog Dialogue, Feb. 2009, pp. 1-4. vol. 43-02.
Office Action in U.S. Appl. No. 13/232,831, mailed Jan. 30, 2013.
Office Action in U.S. Appl. No. 13/436,683, mailed Nov. 9, 2012.
Office Action in U.S. Appl. No. 12/966,965, mailed Dec. 23, 2011.
Korean Patent Application No. 2008-242123, filed Sep. 22, 2008. English translation.
Korean Patent Application No. 2008-312097, filed Dec. 8, 2008. English translation.
International Search Report and Written Opinion in PCT/US2011/051798 mailed Jan. 17, 2012.
International Search Report and Written Opinion in PCT/US2011/062964, mailed Jan. 17, 2012.
International Search Report and Written Opinion in PCT/US2011/051810, mailed Jan. 17, 2012.
"Traps Drums, Portable Acoustic and Electronic Drums," retrieved from www.trapsdrumsusa.com, Apr. 2010.
U.S. Office Action in U.S. Appl. No. 13/232,831, mailed on Aug. 2, 2013.
Office Action in U.S. Appl. No. 13/479,953, mailed Dec. 5, 2013.
Office Action in U.S. Appl. No. 13/595,863, mailed Nov. 14, 2013.
International Search Report and Written Opinion in International Application No. PCT/US2013/042773, mailed Oct. 18, 2013.
International Search Report and Written Opinion in International Application No. PCT/US2013/56674, mailed Nov. 29, 2013.
Supplemental Notice of Allowability in U.S. Appl. No. 12/966,965, mailed Apr. 24, 2013.

* cited by examiner

NON-CONTACT CYMBAL PICKUP USING MULTIPLE MICROPHONES

RELATED APPLICATIONS

This application claims the benefit of U.S. Provisional Pat. Appl. No. 61/383,304 entitled "Non-Contact Cymbal Pickup Using Multiple Microphones" (Ryan et al.) filed on Sep. 15, 2010, the contents of which are incorporated herein by reference in their entirety.

TECHNICAL FIELD

The present disclosure relates generally to the field of amplified and/or electronic percussion devices, and specifically to that of amplified cymbals.

BACKGROUND

Cymbals are known to vibrate in an extremely complex fashion, producing a broad spectral distribution of enharmonic components. Faithfully converting these vibrations to electrical signals for amplification, signal processing, and recording presents a number of challenges. "Close-mic'ing", where microphones are placed in close proximity to the instrument to be amplified, is effective for other instruments such as drums or guitars but is not optimal for a cymbal because of its size, movement, and widely varying spectral content at various locations on its surface. Contact microphones are also suitable for and widely used for drums and guitars; however, contact microphones are problematic for cymbal applications since any contact with or attachment to a cymbal alters or inhibits its natural vibratory characteristics. For these reasons, the most widely-used mic'ing technique is to position one or more microphones several feet away from the cymbal, usually above the cymbal and pointing down at it, thus capturing its overall sound field. This approach has disadvantages in terms of the bulk and weight of the microphone support stands, the cost of individual microphones, additional set-up effort and cost for the microphone support contraptions, and unwanted crosstalk from other nearby instruments.

Cymbals can be very loud when played, which is undesirable when playing in a location where sound levels must be kept low. Electronic drums provide a low-volume alternative to acoustic drums since their volume can be controlled and headphones can be worn; however, currently-available electronic cymbals generally have severe shortcomings in playing feel since their playing surface is usually a resilient material such as plastic or rubber rather than the metallic surface of traditional cymbals, and in nuance of expression since they act as electronic triggers for a limited variety of stored samples rather than using their own natural vibrations. Low-volume metallic cymbals have been developed employing multiple perforations of the cymbal's surface to reduce sound level. These perforated cymbals, however, can suffer from a sound which differs significantly from that of traditional non-perforated or solid cymbals. Whereas traditional cymbals can sound reasonable with no microphones or amplification at all, perforated cymbals require special signal processing in order to achieve acceptable sound quality. This makes a simple, compact, low-cost cymbal microphone or pickup highly desirable in conjunction with perforated cymbals.

Cymbals are designed to swing freely on their stands. No attachment hardware is provided on cymbals themselves since any such hardware attached to a cymbal would interfere with its natural vibrations. Typically, a central hole is provided in the cymbal through which a segment of the stand shaft extends, and the cymbal rests on a resilient washer which interferes minimally with its vibration. When struck, a cymbal may swing on its stand through an arc of forty-five degrees or more. Because of this, a microphone at a fixed location must be distant enough from the cymbal so as not to physically interfere with the cymbal's swing. Furthermore, as the cymbal swings, the distance from a near microphone to the cymbal changes, producing undesirable variation in the amplitude of its output signal.

Various attempts have been made to attach microphones or pickups directly to a cymbal so that the microphone will swing with the cymbal and thereby maintain a constant distance from it. However, as explained above, it has been found that any attachment to the cymbal will inhibit or otherwise alter its natural vibratory characteristics, generally in an undesirable fashion. Schemes employing pickups attached to a cymbal furthermore have to contend with the problem of wire entanglement as the cymbal rotates, and measures have to be taken to limit the cymbal's rotation in order to prevent entanglement, which in turn have the potential to interfere with the cymbal's vibration.

OVERVIEW

Described herein, in accordance with an embodiment, is a pickup that includes a first contactless transducer operable to generate a first transducer signal in response to vibrations in a body, a second contactless transducer operable to generate a second transducer signal in response to the vibrations in the body, a phase inverter configured to invert the phase of the first transducer signal, and a combiner for combining the phase-inverted first transducer signal with the second transducer signal.

Also described herein, in accordance with an embodiment, is a pickup mountable to a cymbal stand shaft that includes a first portion with a first diameter and a second portion with a second diameter greater than the first diameter, the first and second portions separated by a shoulder portion. The pickup has a housing including a hole for passage of the cymbal stand rod therethrough in a mounted position, and a first pair of microphones supported by the housing so as to be spaced 180 degrees apart around the cymbal stand in the mounted position.

BRIEF DESCRIPTION OF THE DRAWINGS

The accompanying drawings, which are incorporated into and constitute a part of this specification, illustrate one or more examples of embodiments and, together with the description of example embodiments, serve to explain the principles and implementations of the embodiments.

In the drawings.

DESCRIPTION OF EXAMPLE EMBODIMENTS

Example embodiments are described herein in the context of a non-contact cymbal pickup using multiple microphones. Those of ordinary skill in the art will realize that the following description is illustrative only and is not intended to be in any way limiting. Other embodiments will readily suggest themselves to such skilled persons having the benefit of this disclosure. Reference will now be made in detail to implementations of the example embodiments as illustrated in the accompanying drawings. The same reference indicators will be used to the extent possible throughout the drawings and the following description to refer to the same or like items.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

The term "exemplary" is used exclusively herein to mean "serving as an example, instance or illustration." Any embodiment described herein as "exemplary" is not necessarily to be construed as preferred or advantageous over other embodiments.

Figure 1:
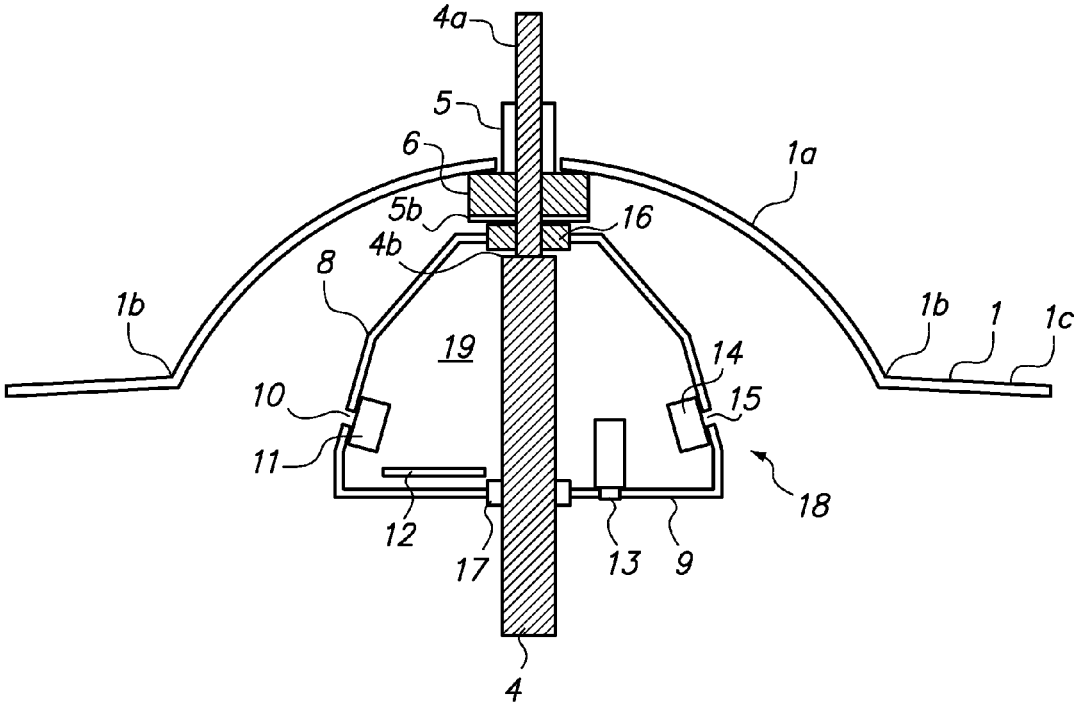
FIG. 1 is a cross-sectional view of a dual point of contact pickup and a cymbal in a neutral position.

Referring to FIG. 1, a vibratable body such as a cymbal 1 is shown in cross section in a neutral position. Cymbal 1 has several distinct vibratory zones 1*a*, 1*b*, and 1*c* that are also shown in cross section. Vibratory zone 1*c* actually extends considerably beyond the borders of FIG. 1 but is only partially shown for clarity. Vibratory zone 1*a* is commonly referred to as the "bell" or "cup" of the cymbal and consists of an area with a cross-sectional radius much smaller than that of the rest of the cymbal. The "bell" of a cymbal, as its name suggests, tends to have a distinct bell-like ringing tone, and this zone is deliberately struck in many styles of music to produce that tone. Vibratory zone 1*c* is commonly referred to as the "bow" of a cymbal and comprises the majority of the cymbal's surface area. The bow (zone 1*c*) of the cymbal produces a more enharmonic spectrum than the bell and is used to produce crashes and gong-like effects. The outermost portions of the bow area produce much more vibratory energy at low frequencies than do areas closer to the cymbal's center.

The area of transition, or inflection point, between the bell and bow regions of a cymbal, labeled 1*b* in FIG. 1, is an optimal location for picking up the most musically-desirable vibrations using a small microphone placed near the cymbal. Microphone placement nearer the cymbal's center tends to produce excess bell tone and high-frequency ringing, which is perceived as "harshness" by listeners. Microphone placement farther from the cymbal's center tends to produce excess low frequency components, perceived as "muddiness" or being too "gong-like". Because of these zonal differences in the characteristics of the vibrations and sounds generated by the cymbal, it can be seen that variations in the position and orientation of the cymbal relative to a pickup device will significantly impact the output of the pickup device. That is, whether, in one position in a swing cycle the bow (zone 1*c*) of the cymbal is closer to the microphone, or, in another position of the swing cycle the bell is closer, will significantly determine the nature of the output generated by the pickup device in response to a strike of the cymbal.

Referring again to FIG. 1, cymbal 1, which can be the solid, non-perforated type of cymbal or the perforated type, is mounted onto a cymbal stand shaft 4 which is part of a cymbal stand (not shown). Center hole 7 of cymbal 1 passes over stand shaft 4 and tee bushing 5 such that cymbal 1 rests on resilient washer 6, configured to allow the cymbal to vibrate as freely as possible. Resilient washer 6 in turn rests on the shoulder 5*b* of tee bushing 5. Stand shaft 4 and tee bushing 5 can be equipped with mating threads (not shown) to secure them to each other. Stand shaft 4 can include a step 4*b* at which point its diameter decreases to portion 4*a*, providing a point where a washer or other cymbal support device can rest in the absence of a threaded bushing or the like. An additional resilient washer and threaded nut or other clamping device (not shown) can be placed on stand shaft 4 above the cymbal to secure it and control its motion.

Also seen in FIG. 1 is a resiliently-mounted dual point of contact pickup 18 having a housing including a side 8 and a bottom 9. Grommets 16 and 17 isolate the side 8 and bottom 9, respectively, along with the internal components of pickup 18, from the vibrations of the cymbal stand (not shown). To that end, grommets 16 and 17 may be formed of a dampening or resilient material, such as rubber or soft polymer or the like. The side 8 and a bottom 9, together with grommets 16 and 17, are supported by stand shaft 4 such that, in the example shown, grommet 16 is interposed on shaft 4 between shaft step 4*b* and bushing shoulder 5*b*. While step 4*b*, commonly present on standard cymbal stand shafts, makes this particular mounting scheme convenient and attractive, it will be apparent to those skilled in the art that other means of attaching the pickup 18, such as threads (not shown), are contemplated. It will be appreciated that "point of contact" refers to a region at which the pickup is coupled to the stand shaft, and is not necessarily limited to a single infinitesimally small point. The references to single or dual points of contact are primarily a convenient manner for distinguishing the two arrangements described herein, and to indicate that the pickup is mounted to the stand shaft at only one region in the single point of contact arrangement, and at two regions in the dual point of contact arrangement.

Pickup 18 includes, within the interior chamber 19 defined by side 8 and bottom 9, two contactless transducers in the form of microphones 10 and 14. These may be positioned diametrically opposite each other, 180 degrees apart, and aimed at two points likewise diametrically opposed, preferably on cymbal inflection point 1*b*. Openings 10 and 15 in side 8 allow sound waves from the cymbal to better penetrate the housing of the pickup 18 to the microphones. The openings may be filled with sound-permeable material (not shown) such as mesh, foam or the like, that may or may not modify the sound reaching the microphones 10 and 14. While only two microphones are shown, a different number is contemplated, spaced evenly or unevenly apart around the circumference of the side 8. As shown, with the cymbal 1 in its flat or neutral position in FIG. 1, the microphones 11, 14 are equidistant from the cymbal 1, and therefore their respective output signal amplitudes will be roughly equal to each other in the position shown. The significance of this preferred, but not mandatory, arrangement is explained below.

Also incorporated in pickup 18, mostly within the interior chamber 19 defined by side 8 and a bottom 9, is a jack 13 communicating with the exterior for conveniently connecting the microphone signals to external amplification and/or signal processing equipment, although such connection may be implemented wirelessly instead. In addition, printed circuit board 12 is provided in the interior chamber 19 defined by side 8 and a bottom 9 and incorporates electronic circuitry such as for internal buffering and mixing of the two microphone signals.

Figure 2:
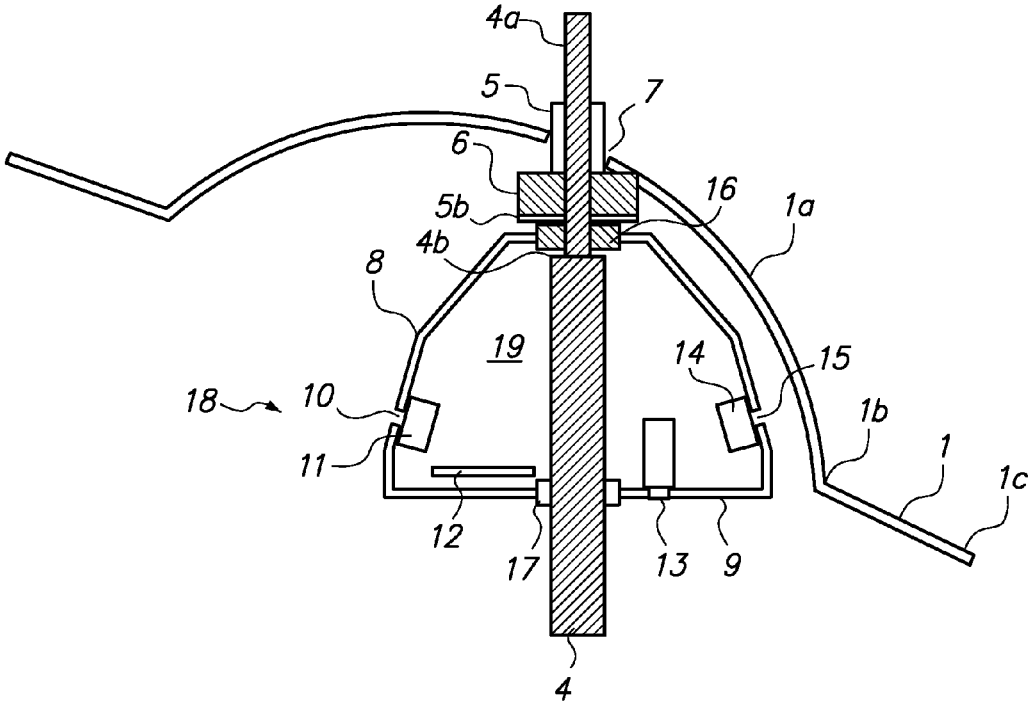
FIG. 2 is a cross-sectional view of the dual point of contact pickup and cymbal in a struck or swinging position.

FIG. 2 shows the cymbal 1 in a tilted position after being struck. It can be seen that in this state, microphone 14 is much closer to the cymbal than microphone 11. The output amplitude of microphone 14 will as a result be greater than its output under the conditions shown in FIG. 1, and the output of microphone 11 will conversely be smaller. By electrically combining ("mixing") the outputs of the two microphones, either by circuits in pickup 18 or by external means, an aggregate signal is obtained whose perceived loudness when amplified is acceptably constant regardless of cymbal tilt. The exact degree of amplitude independence with respect to cymbal tilt depends to some extent on the axis of cymbal tilt, the particular aiming and directional characteristics of microphones 11 and 14, and the cymbal's shape, but in practice the overall degree of tilt immunity that can be realized has been found to be acceptable with a variety of common cymbal shapes using two microphones arranged as disclosed herein. It will be apparent to those skilled in the art that even greater cymbal tilt immunity can be achieved by adding more microphones, with an accompanying increase in cost and complexity, but the principle would remain substantially the same. Thus as described herein, a pickup that is substantially independent of cymbal orientation and position is achieved, particularly when two or more microphones that are evenly spaced apart are used. In addition to relying on the physical spacing of the microphones to achieve tilt immunity, electronic techniques akin to beam steering and microphone directionality can be used.

Figure 3:
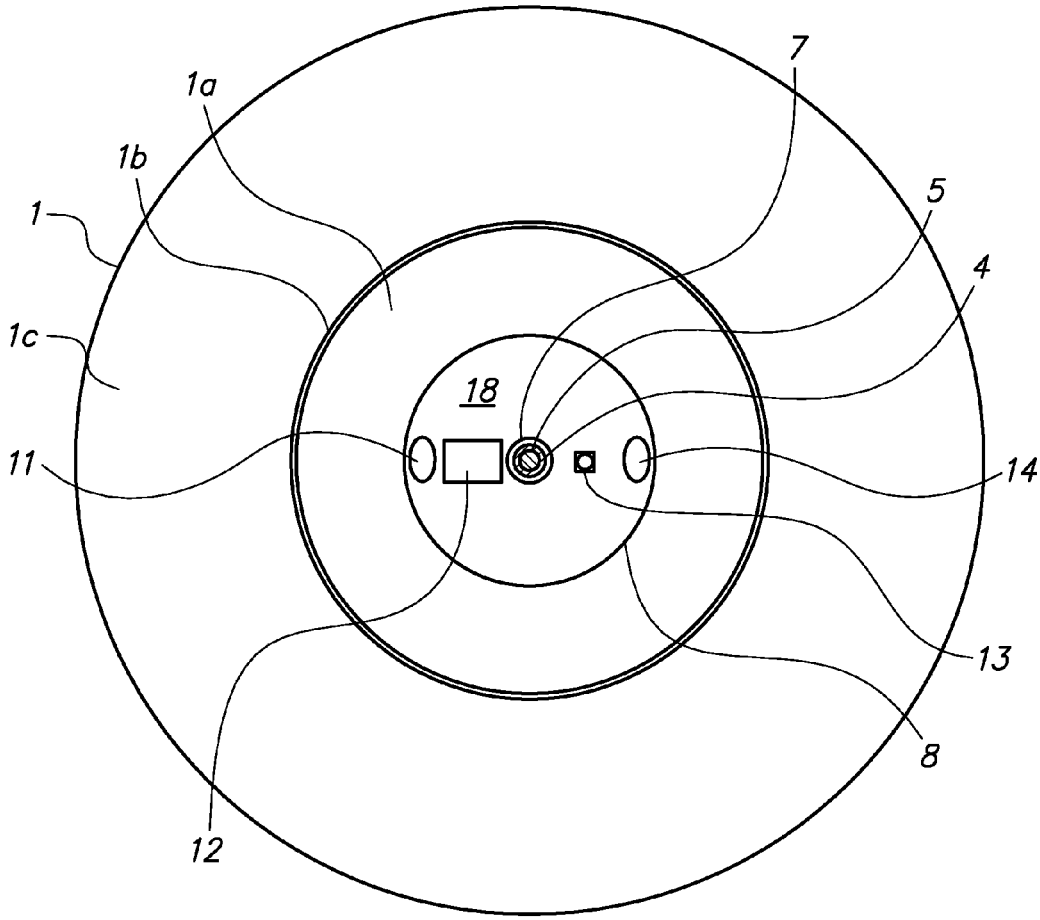
FIG. 3 is a bottom sectional view of a pickup and cymbal in a neutral position.

FIG. 3 shows a bottom sectional view of the installation of pickup 18 on a stand shaft 4, below cymbal 1, with a more clearly visible view of the diametrically-opposed microphone placement.

Figure 4:
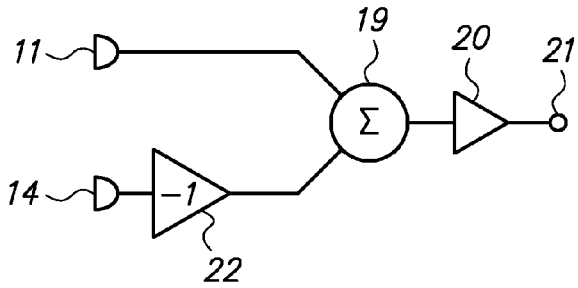
FIG. 4 is a block diagram of signal conditioning circuitry.

FIG. 4 is a block diagram of signal conditioning circuitry used in what will be referred to herein as a phase-inverting configuration. The phase-inverting configuration is used to condition signals from microphones 11 and 14 for improved pickup performance. In the phase-inverting configuration, also referred to as an out-of-phase connection, the phase of one of the microphones is inverted prior to combining the microphone outputs. The inversion is implemented using an inverter 22. This approach greatly improves the resultant sound quality of the combined output signal. The out-of-phase microphone connection operates to cancel signals which are in phase with one another and augment signals that are out of phase with one another. The scheme, along with a suitable arrangement of the microphones and placement of the pickup, exploits the fact that the more desirable components of the cymbal's vibration at inflection point 1*b* are out of phase with each other, whereas the less-desirable components are in phase with each other.

After the inversion of one of the microphones (in this case microphone 14, but alternatively it can be microphone 11), the two signals are combined by a summation block 19, using techniques well-known to those skilled in the art. The combined signals are then buffered by buffer amplifier 20 in order to present a low impedance output at output point 21, which is connected to output jack 13 (FIGS. 1 and 2) and/or other processing circuitry. The conditioning, including the phase inversion and summation, can be performed either internally, in circuits disposed within pickup 18, or externally using other circuits, devices or software modules. Further, it can be performed in the analog or digital domains, or in a combination of these depending on design choice.

To facilitate some external conditioning processes, the two (or more) microphone outputs can be independently made available to external circuitry. The means of signal inversion will depend on the type of microphone used. The two most common microphone types employed in this type of application are electret condenser and dynamic. Since electret condensers are polarized devices they need an electronic circuit to achieve phase inversion. Dynamic microphones, on the other hand, are comprised of a coil of wire and a magnet, and their phase can be inverted by simply reversing the connections of the coil of one of the microphones.

Figure 5:
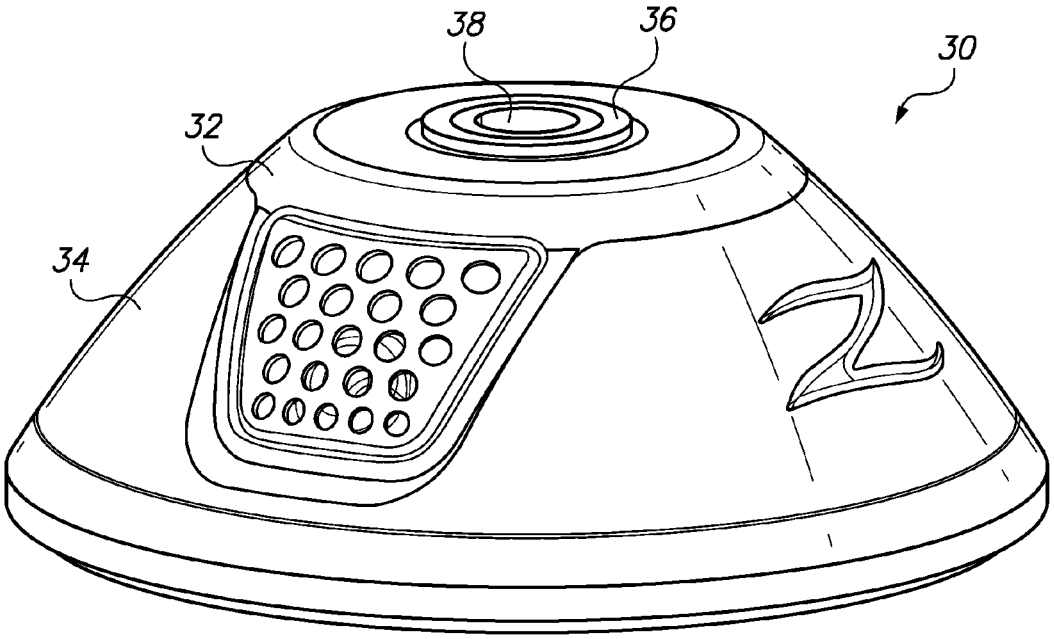
FIG. 5 is a perspective view of a single point of contact pickup.
Figure 6:
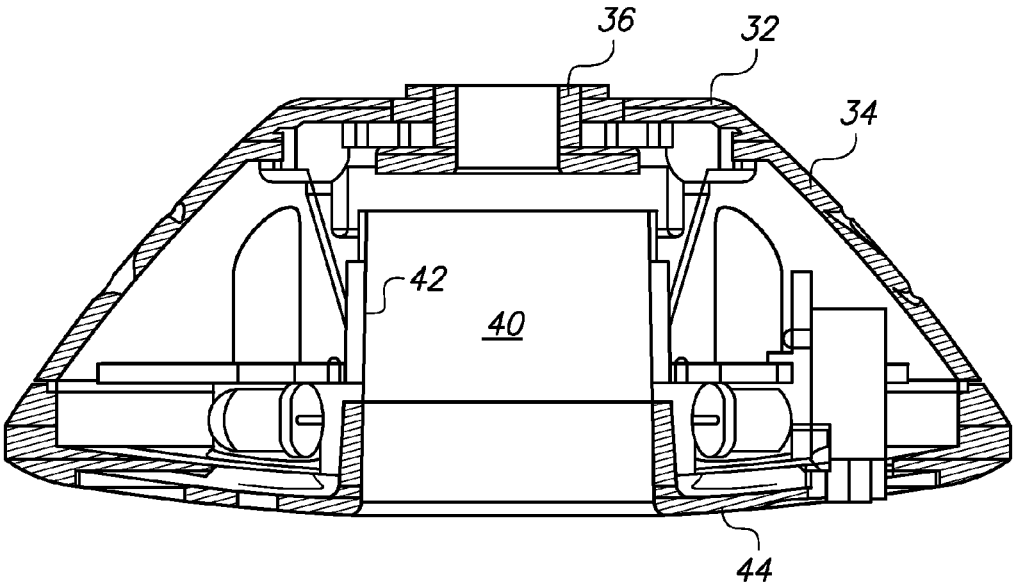
FIG. 6 is a cross-sectional elevational view of a single point of contact pickup.
Figure 7:
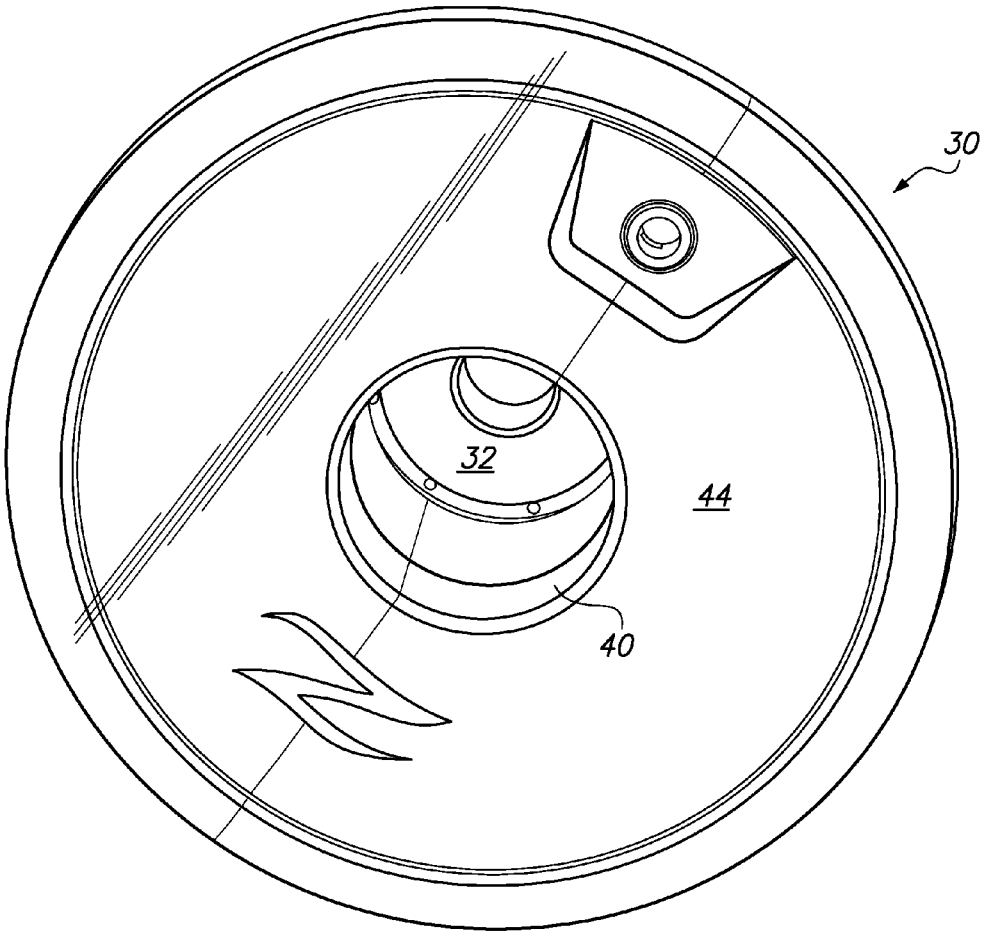
FIG. 7 is a bottom perspective view of a single point of contact pickup.
Figure 8:
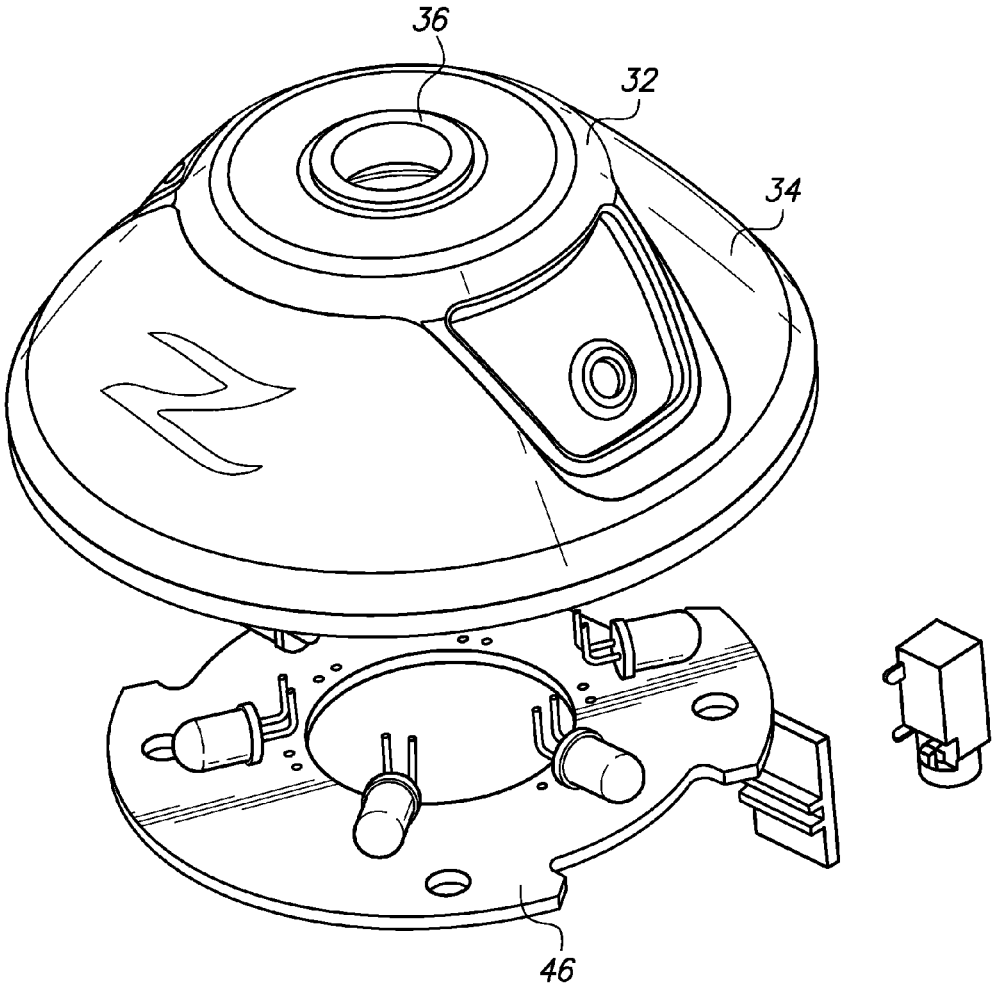
FIG. 8 is an exploded view of a single point of contact pickup.

FIG. 5 is a perspective view of a pickup 30 in accordance with another embodiment. Pickup 30 comprises a single-point of contact housing formed of a side having a resilient boot portion 32 connected to a relatively more rigid shell portion 34 and capped by a bottom portion 44. Pickup 30 is configured to have a single point of contact with stand shaft 4 (FIG. 1) of the cymbal stand (not shown). This single point of contact, disposed on resilient boot portion 32 comprises a hub 36 that rests on step 4*b* (FIG. 1) of stand shaft 4 and is sized accordingly, with the diameter of the hole 38 therethrough being about the same (optionally for interference fit) as that of the upper portion 4*a* of the shaft but smaller than that of the lower portion of shaft 4 in a similar manner to grommet 16 described above. Alternatively, hub 36 can be threaded for mating with complimentary threads formed in the shaft (not shown). Pickup 30 is configured to have a central axial passage 40, best seen in the cross-sectional view of FIG. 6 and the bottom perspective view of FIG. 7. Axial passage 40 is defined by cylindrical inner wall 42 and is configured to accommodate shaft 4 without contact, such that the pickup 30 is suspended exclusively from hub 36. In this manner, the main body of the pickup 30, consisting of the rigid shell portion 34, bottom portion 44 and the pickup contents such as the circuit board 46 (exploded view in FIG. 8) and microphones (not shown), are insulated from vibrations from the shaft 4 by operation of resilient boot portion 32 serving to isolate the main body from the single contact point provided by hub 36.

Some advantages of the above arrangements include compactness, ease of mounting, reduced cost, improved sound quality, immunity to cymbal tilt, freedom from interference with natural cymbal vibration, freedom from the need for any attachment to the cymbal, and freedom from wire entanglement problems.

Figure 9:
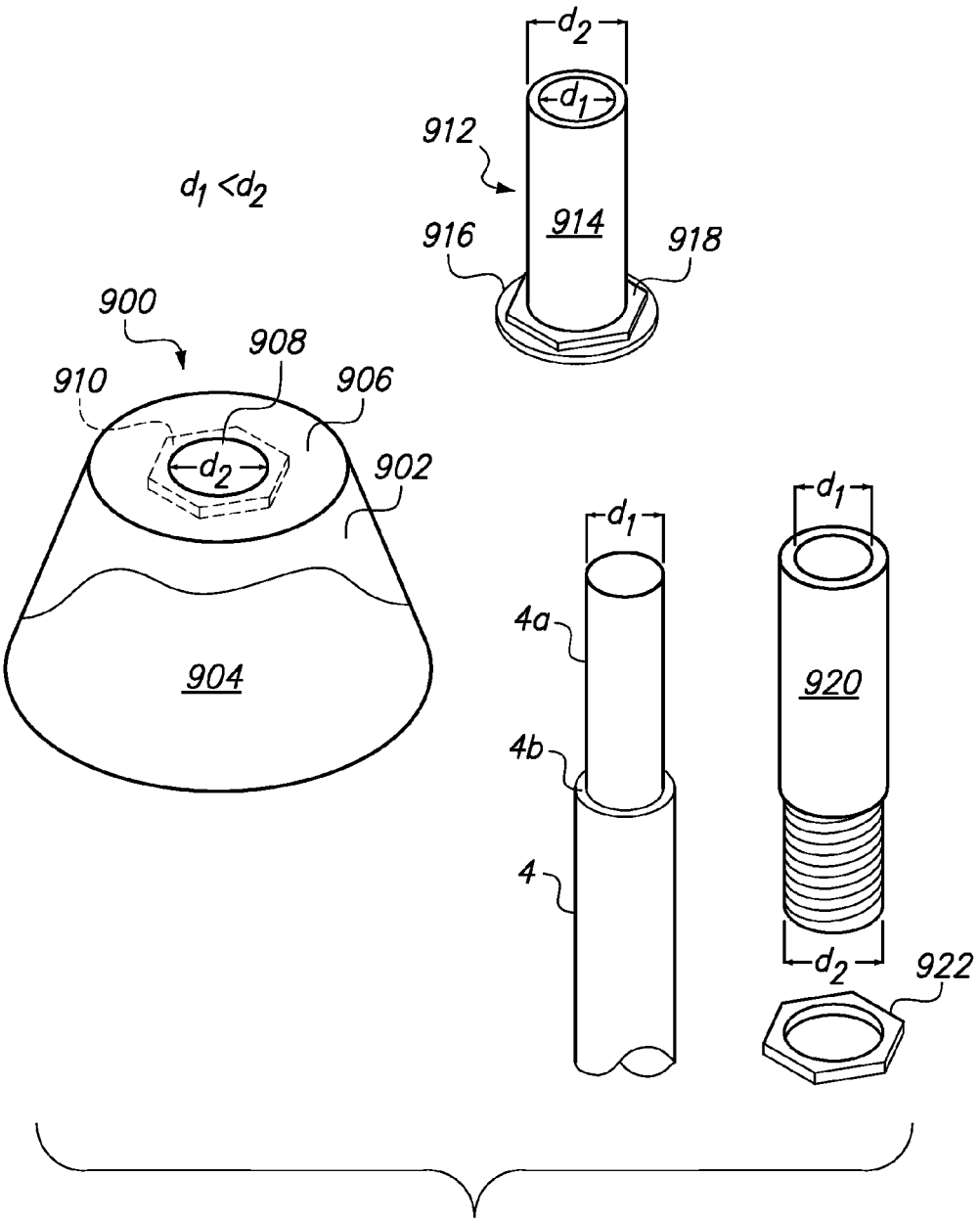
FIG. 9 is a perspective view of various components of a pickup mounting assembly.

FIG. 9 is a perspective view showing various components of a pickup mounting assembly in accordance with one embodiment. The pickup 900, of the single point of contact type, generally comprises a resilient boot portion 902 and a relatively more rigid shell potion 904. A hub 906 includes hole 908 having an inner diameter d2. The underside of hub 906 includes a recess 910 which, in this example, is hexagonal in shape, and shown in broken lines.

The mounting assembly further includes a removable sleeve 912 having a cylindrical portion 914 with an inner diameter d1 and an outer diameter substantially equal to d2 for engaging hub 906 and hole 908 therein. Sleeve 912 further includes a flange 916 and raised feature 918 that conforms in shape to recess 910 for engagement therewith, and in this example is therefore hexagonal in shape as well. Cylindrical portion 914, flange 916 and raised feature 918 are integrally formed with each other. It should be noted that the locations of the recess and raised feature can in some embodiments be reversed, with the sleeve having a recess and the hub having a raised feature. In general, the housing and removable sleeve can be characterized as including complementary recessed and raised features that are configured to mate with each and that are shaped, in one embodiment, to prevent relative rotation between the housing and removable sleeve.

Also shown in FIG. 9 is a cymbal stand 4 and high-hat cymbal clutch shaft 920. Cymbal stand 4 includes upper, reduced diameter portion 4*a* and shoulder 4*b*, as explained above. The diameter of portion 4*a* is substantially equal to or less than d1, such that sleeve 912 can fit thereover.

Clutch shaft 920 is hollow, having an inner diameter equal to about d1 for fitting over reduced diameter portion 4*a* of stand 4, and an outer diameter equal to about d2 for fitting within hole 908 of pickup 900. At one end, the exterior of clutch shaft 920 is threaded, for engagement with threaded nut 922, which is shaped so as to fit in recessed portion 910 of pickup 900.

Figure 10:
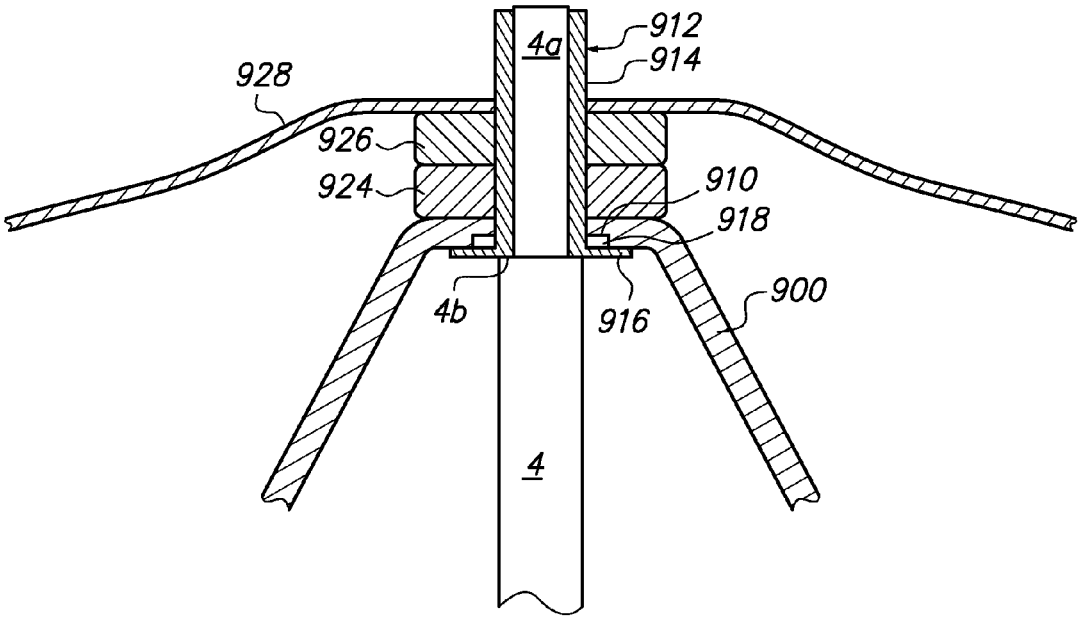
FIG. 10 is a cross-sectional view of a non-high hat mounting arrangement.

The mounting assembly show in FIG. 9 enables mounting pickup 900 in both a regular and high-hat cymbal configurations. In the regular, non-high-hat mode, illustrated in FIG. 10, sleeve 912 is inserted over portion 4*a* of stand 4, and rests on shoulder 4*b*. Pickup 900 is then slipped over cylindrical portion 914 of sleeve 912, to rest on flange 916 of the sleeve. Raised feature 918 then sits in recess 910. Foam washers 924, 926 are then disposed on top of the assembly, for supporting the regular, non-high-hat cymbal 928 in place.

Figure 11:
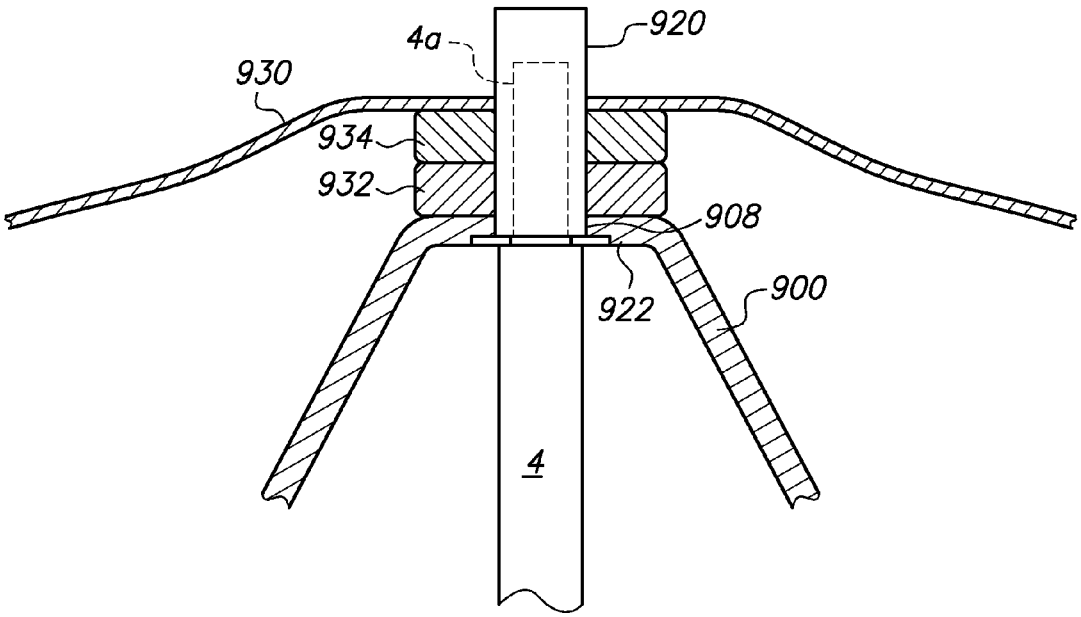
FIG. 11 is a cross-sectional view of a non-high hat mounting arrangement.

In the high-hat cymbal mode, shown in FIG. 11, the sleeve 912 is not used. Clutch shaft 920, to which the high-hat cymbal 930 is mounted, is passed through hole 908 in pickup 900, and nut 922 is placed in recess 910 and threaded over the threaded portion of shaft 920. Clutch shaft 920, with the pickup 900 thus attached thereto, is then slid over portion 4*a* of stand 4 for support thereby. Foam washers 932, 934 are disposed between the pickup 900 and the cymbal 930.

The assembly of FIG. 9 provides several advantages, including the ability to use a "universal" pickup housing design that is usable with both high-hat and non-high-hat cymbal configurations without modification. Further, by forming sleeve 912 of a resilient material, improved acoustic isolation from undesirable vibration from the inner edge of the cymbal's central hole can be realized.

Figure 12:
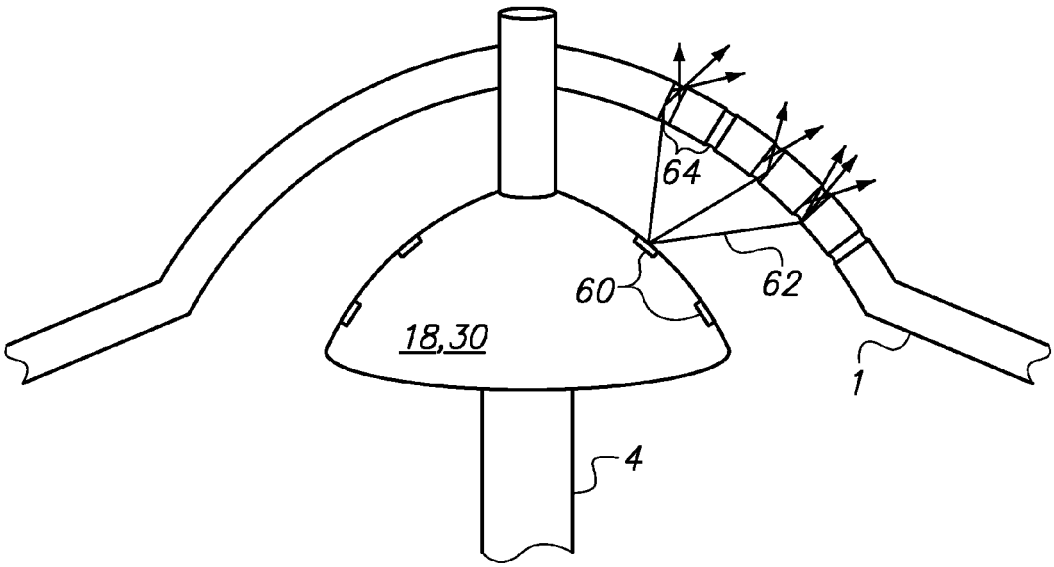
FIG. 12 is a partial cross-sectional view showing an illuminated perforated cymbal.

In one embodiment, shown in FIG. 12, the pickups 18 or 30 can include light sources, such as multi-colored LEDs 60, for providing decorative illumination, and/or for example directing light 62 of any desirable color and in any desirable arrangement onto the cymbal 1 to illuminate the cymbal from below. This is particularly attractive for perforated cymbals, as the lights can penetrate the cymbal and provide a dazzling effect as they interact with the perforations 64. Alternatively or in addition, the light can be in the form of an illuminated ring disposed along the circumference of the pickup, at the bottom thereof or elsewhere, or it can be any form of illuminated features, such as lines, points, characters, symbols, and so on.

Figure 13:
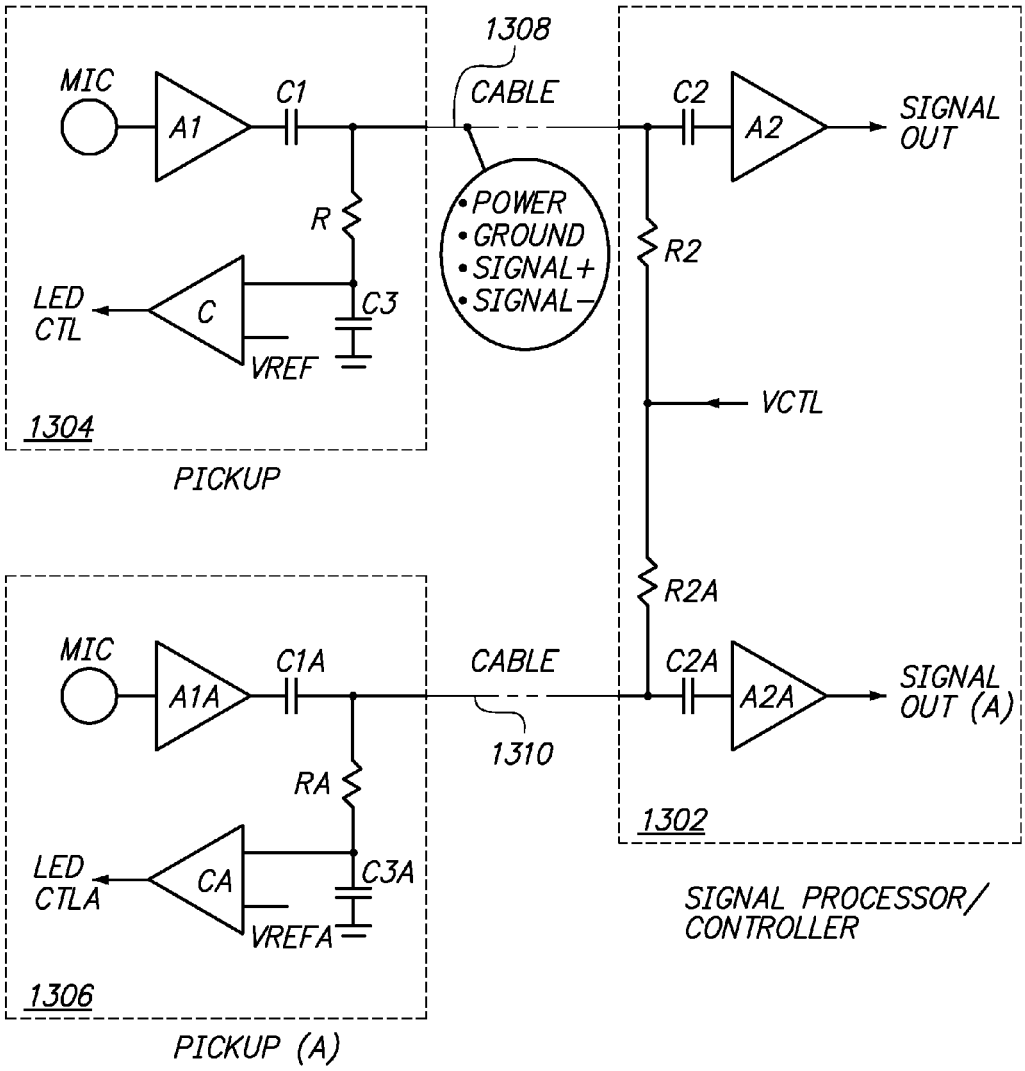
FIG. 13 is a schematic diagram of a lighting power and control scheme.

FIG. 13 is a schematic diagram showing a power and control scheme 1300 for a lighting configuration. In this scheme, a single controller having a processor 1302 is used to control the lighting for two pickups, 1304 and 1306, coupled to the processor by way of cables 1308, 1310. Typically, each cable consists of four conductors: power, ground, signal + and signal −. The lighting power and control scheme applies an illumination control signal VCTL, in the form of a DC bias, from the processor 1302 (or from a dedicated switch, not shown) for activating or deactivating pickup lights. The activation/deactivation signal appears as an output LED CTL, LED CTLA of comparators C, CA. DC blocking capacitors C1, C1A and C2, C2A are provided at each end of the cables 1308, 1310, between the outputs of the preamplifiers A1, A1A on the one side, and the inputs amplifiers A2, A2A on the other, with the amplified microphone outputs emerging as the SIGNAL OUT, SIGNAL OUTA signals at the processor 1304. The VCTL signal is applied to one of the signal bias conductors, signal + or signal −, of each of the cables 1308, 1310, via resistors R2, R2A. The VCTL signal then appears as an input at an associated comparator C, CA in each of the pickups 1304, 1306. The other input to the comparator is a reference signal VREF, VREFA. Capacitors C3, C3A operate with the resistors R2, R2A, and, optionally, R and RA, as low pass filters. The circuit operates to sense the presence or absence of the DC bias signal VCTL by means of comparators C, CA, which may each be comprised of a single op-amp. The lights are directly controlled within the pickup by the output of the comparators, whose output states (high or low) are determined by which of their two inputs is at a greater DC voltage.

The DC control signal VCTL is isolated from the audio signal from the microphones by means of the blocking capacitors C1, C1A and C2, C2A at each end of the signal path. Since the control signal is a DC level, it is readily low-pass filtered in order to remove any stray noise that it might introduce into the signal path.

As explained above, the VCTL is a DC bias control voltage which can come from processor 1304 or from a dedicated switch (not shown). VCTL DC voltage is superimposed on the audio (AC) signal also being carried by the cable 1308, 1310. It will not affect the audio signal in the cables, nor will any DC levels on A1 or A2, or A1A or A2A, affect the control voltage, since DC is blocked at both ends by C1 and C2, and C1A and C2A.

The cable signal is coupled to the input of the comparators C, CA via the low pass filters described above, whose purpose is to remove any AC signal from the pickup audio from the signal being presented to the comparator, since any AC component could cause "flicker" of the controlled lights. Since response time of the lighting control system can be very slow compared to audio frequencies, a filter with a very low cutoff frequency (<1 Hz) can be used to substantially completely remove all AC from the comparator input signal.

Since the input of lowpass filters R, R2/C3 and RA, R2A/C3A (whose output is in turn connected to the inputs of comparators C, CA) are connected between C1 and C2, the comparators are able to sense the DC signal superimposed on the cable while ignoring any AC component.

In one embodiment, VCTL has two possible values: "On" and "Off". In another embodiment, this scheme is expanded to multiple values (for example for controlling lighting brightness) by using multiple comparators with different reference thresholds, or analog-to-digital converters in place of comparators C. In the two-state system detailed above, the circuit values are chosen so that in one of the two states VCTL is higher than VREF and in the other state it is lower. Changing VCTL from one level to another causes comparators C, CA to change state, thereby causing the lights to turn on or off accordingly.

It will be understood that while described in terms of use with a non-high hat cymbal, the above arrangements are equally applicable to high hat type of cymbals with minor modifications to the mounting schemes used.

While embodiments and applications have been shown and described, it would be apparent to those skilled in the art having the benefit of this disclosure that many more modifications than mentioned above are possible without departing from the inventive concepts disclosed herein. The invention, therefore, is not to be restricted except in the spirit of the appended claims.

The invention claimed is:

1. A pickup for converting vibrations from a cymbal mounted on a stand to electrical signals, the pickup comprising:

a housing mountable at a single point of contact to the cymbal stand, the housing including:

a first contactless transducer operable to generate a first transducer signal in response to the vibrations in the cymbal;

a second contactless transducer operable to generate a second transducer signal in response to the vibrations in the cymbal;

a phase inverter configured to invert the phase of the first transducer signal; and a combiner for combining the phase-inverted first transducer signal with the second transducer signal to thereby generate the electrical signals.

2. The pickup of claim 1, wherein the first and second transducers, comprising a first pair of transducers, are disposed 180 degrees apart.

3. The pickup of claim 1, further comprising one or more additional pairs of transducers, the transducers in each additional pair being disposed 180 degrees apart.

4. The pickup of claim 1, further comprising a buffer amplifier for amplifying an output of combiner.

5. The pickup of claim 1, wherein the housing comprises:

a side supporting the single point of contact;

a bottom coupled to the side; and a cylindrical inner wall coupled to the bottom and defining a passage for passage of the shaft therethrough.

6. The pickup of claim 5, wherein the side comprises a resilient boot portion having a hub in which a hole is formed for passage of the shaft therethrough.

7. The pickup of claim 6, wherein the housing is supported by the shaft at the first point of contact by way of a step formed in the shaft.

8. The pickup of claim 1, further comprising illuminated features.

9. The pickup of claim 8, wherein the illuminated features are LEDs.

10. The pickup of claim 8, wherein the illuminated features are multi-colored.

11. The pickup of claim 10, wherein the cymbal is a perforated cymbal.

12. The pickup of claim 1, wherein the cymbal is a perforated cymbal.

13. The pickup of claim 1, wherein the cymbal is a high-hat cymbal.

* * * * *